US006889535B1

(12) United States Patent
Ericson

(10) Patent No.: US 6,889,535 B1
(45) Date of Patent: May 10, 2005

(54) TOOL ASSEMBLY

(75) Inventor: Jan Ericson, Borlänge (SE)

(73) Assignee: Hyfotec Sweden AB, Borlange (SE)

( * ) Notice: Subject to any disclaimer, the term of this patent is extended or adjusted under 35 U.S.C. 154(b) by 184 days.

(21) Appl. No.: 10/130,135

(22) PCT Filed: Nov. 15, 2000

(86) PCT No.: PCT/SE00/02235

§ 371 (c)(1),
(2), (4) Date: Oct. 8, 2002

(87) PCT Pub. No.: WO01/36123

PCT Pub. Date: May 25, 2001

Related U.S. Application Data

(60) Provisional application No. 60/165,936, filed on Nov. 17, 1999.

(30) Foreign Application Priority Data

Nov. 17, 1999 (SE) ..... 9904151

(51) Int. Cl.[7] ..... B21D 22/10
(52) U.S. Cl. ..... 72/61; 72/455
(58) Field of Search ..... 72/57, 58, 59, 72/61, 62, 63, 455; 29/421.1

(56) References Cited

U.S. PATENT DOCUMENTS 3,592,034 A 7/1971 McMeen
5,600,983 A * 2/1997 Rigsby ..... 72/61
5,927,120 A 7/1999 Marando
5,941,112 A * 8/1999 Ghiran et al. ..... 72/55
6,018,971 A 2/2000 Kleinschmidt
6,032,501 A 3/2000 Bihrer
6,510,720 B1 * 1/2003 Newman et al. ..... 72/61
6,536,251 B2 * 3/2003 Marando et al. ..... 72/61

FOREIGN PATENT DOCUMENTS

EP 0 686 440 12/1995

* cited by examiner

*Primary Examiner*—David Jones
(74) *Attorney, Agent, or Firm*—Young & Thompson

(57) ABSTRACT

A tool assembly (1) in which a tool closing force (CF) is applied to a forming tool (2) by means of closing force actuators (40). In a tool closing position each closing force actuator engages a lower tool section (4) and an upper tool section (3) through tool clamps (31A, 31B). The clamps take up the major portion of the tool separating force generated by the internal pressure of the forming tool. Only a small portion of the tool separating force has to be counteracted by the closing force actuators, the size of which can be substantially reduced. The elasticity of the clamp material results in a widening of the clamp under the influence of the tool separating force, and this clamp widening is compensated by the readjustment of the clamp through the application of the closing force.

35 Claims, 11 Drawing Sheets

FIG. 10
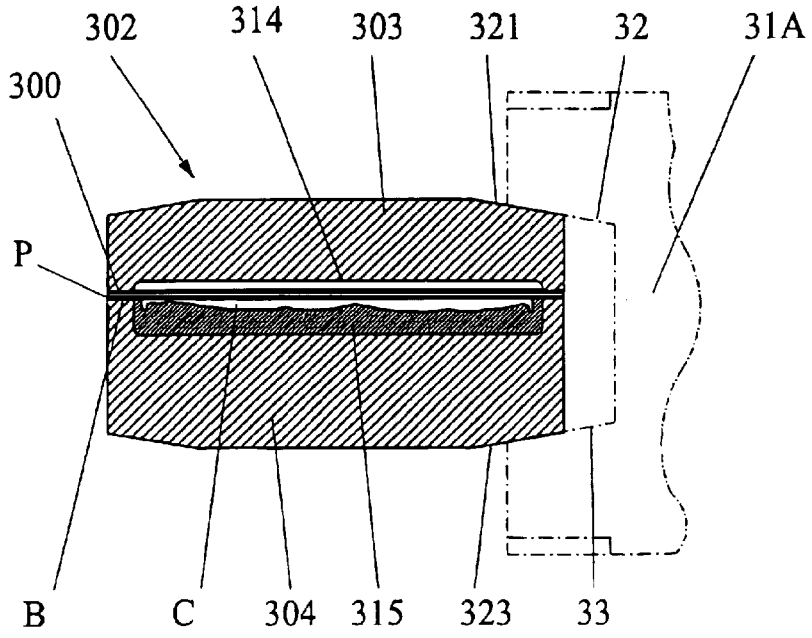
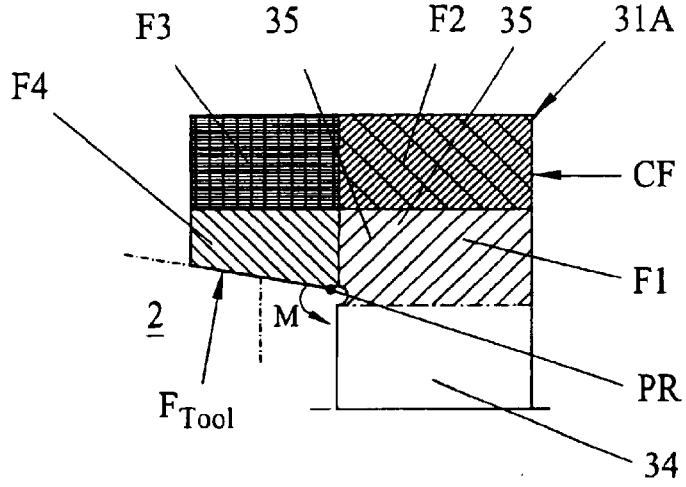
FIG. 6

FIG. 8
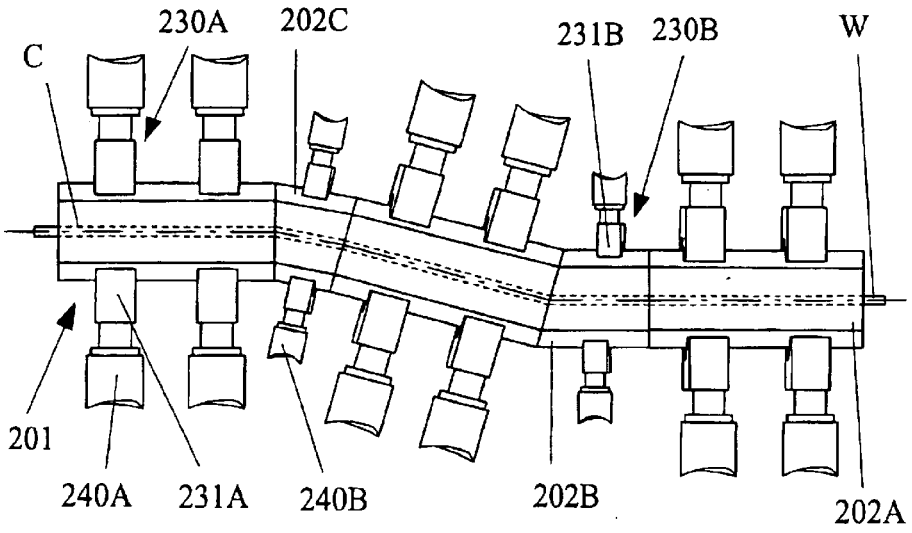
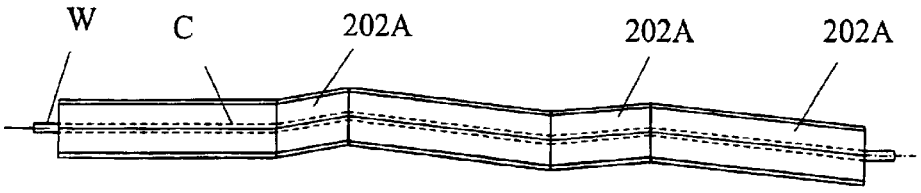
FIG. 9

TOOL ASSEMBLY

This application is a 371 of PCT/SE00/02235 filed Nov. 15, 2000. Further this application claims priority to U.S. Provisional Patent Application No. 60/165,936, filed on Nov. 17, 1999.

TECHNICAL FIELD

The present invention relates generally to tool assemblies and in particular relates to improvements in methods and devices for closing tool assemblies and for maintaining them closed during tool operation.

BACKGROUND

Hydroforming is a well known process for forming metal workpieces by means of pressurized fluid. It is performed using high fluid pressures that are applied internally—such as by internal hydroforming of tubes or pipes—or externally—such as by hydromechanical forming or flexforming of sheet metal—to workpieces that are mostly relatively thin-walled and that are positioned in a tool. In the internal hydroforming the conventional tools consist of upper and lower tool halves and/or tool holder halves that are vertically movable relative to each other. The tool halves carry upper and/or lower dies respectively, and are relatively movable between an open position for loading blanks and for unloading processed workpieces, and a closed position in which the fluid pressure is applied to the blank. Generally speaking the blank is formed by forcing it into contact with the wall or walls of a hollow space or cavity formed by the die or dies between the tool halves. In the flexforming process the upper tool half/tool holder is replaced by a plate holder which through a flexible membrane closes the die cavity formed in the lower tool and which forms a pressure fluid space above the membrane and the blank. However, in this specification this type of plate holder for the flexforming process will likewise be generally referred to as an upper tool half.

The very high fluid pressures applied to the workpiece for the forming operation generate extreme outwardly directed forces acting to push the dies and thereby the tools apart. The fluid pressure applied to the workpiece, and thus also to the tool halves, from within the hollow space formed by the dies, is often in the order of several thousand bars. The resulting tool separating forces are likewise extremely high, and will for most applications amount to several thousand kN. Obviously it is vital for the hydroforming process that the tool halves and specifically the dies are securely closed and maintained in their mutual position during the entire forming process. In the conventional apparatus for performing hydroforming a powerful press provides the extreme closing forces. Normally the press ram carries the upper tool half and the lower tool half is stationary and supported on a machine base.

The conventionally employed press may be required to produce a closing force of up to about 100 000 kN and is in any event, even for hydroforming processes for smaller workpieces, extremely expensive and requires a great amount of space. Naturally, the very high cost of the press and the complexity of the hydroforming apparatus, as such, make the total investment cost unbearable to many small and middle size companies, and thereby limits the availability of the hydroforming processes. In practice the conventional technique will therefore only be available to larger companies. The hydroforming techniques have exceptional advantages over many traditional forming techniques, and therefore there is a general need within this field for improvements that may reduce the complexity and cost of the equipment for hydroforming and that may simplify the process.

Although the above discussed problems and circumstances are emphasized within the field of hydroforming they do indeed also exist within other technical fields, such as injection molding. Therefore the need for improved technical solutions eliminating tool closing and holding problems is not restricted to said hydroforming field, but applies to any molding or forming technique working with raised internal pressures.

RELATED ART

U.S. Pat. No. 5,927,120 discloses an apparatus for performing hydroforming of the general kind described above. The apparatus comprises upper and lower pressure vessels, each carrying a tool holder for receiving a corresponding tool or die section. The apparatus is provided with mechanical locking means for locking the upper and lower pressure vessels to each other during the forming process. Said locking means consist of locking pins that may be inserted into and retracted from complementary holes in the pressure vessels, performing a pure latching function in their inserted position. According to the patent the apparatus is deliberately designed so as to allow outward deflection of the pressure vessels under the influence of the force from the fluid pressure applied to the workpiece. In other words no closing force is applied to the pressure vessels. Instead, the die sections are forced into engagement with each other by pressurizing an inflatable bladder positioned underneath the lower die section.

SUMMARY

The invention overcomes the above problems in an efficient and satisfactory manner.

A general object of the invention is to provide a solution to the problem of securely and accurately holding together the tool halves of a forming tool that during the forming process experiences a very high internal pressure.

In particular, it is an object of the invention to provide an improved tool assembly presenting an uncomplicated and inexpensive solution to the above discussed problems. Briefly, this is achieved by means of a tool assembly in which a tool closing force is applied to a forming tool by means of at least two closing force actuators. In a tool closing position said closing force actuators apply a closing force to a lower tool section and an upper tool section through a pair of tool clamps. The tool clamps and the respective tool sections engage each other with inclined contact surfaces. The actuators apply the tool closing force during a forming process, whereby the clamps take up a portion of a tool separating force generated by internal forming pressure in the tool. The elasticity of the clamp material results in a certain widening of the clamp under the influence of the too separating force, and this clamp widening is compensated for by the continuous readjustment of the clamp through the application of the closing force. Only a reduced portion of the full tool separating force has to be counteracted by the closing force actuators, the size of which will therefore be reduced.

In an embodiment of the invention the actuators are linear actuators applying the closing force in a direction substantially parallel to a parting plane of the forming tool. This provides for an effective and yet simple and inexpensive design.

In a further practical embodiment the actuators are hydraulic cylinders being connected to at least one tool clamp of a pair by means of their piston rods. By connecting the hydraulic cylinders to a variable pressure fluid source it is furthermore possible to vary the applied closing force in dependence upon actual forming pressures.

In further embodiments the tool clamps are made up of a base portion and jaws extended outwardly from said base portion, the actuators applying their closing force to the jaws, preferably to outer areas thereof. With such embodiments it is possible to positively counteract the tendency of the clamps being widened by tool separating forces.

In order to reduce friction between inclined contact surfaces of the tool and the clamps, and thus the wear of said surfaces, it is suggested to provide steel plates in the contact surfaces of the tool and to provide plates of a synthetic material in the contact surfaces of the clamps.

In further embodiments of the invention the contact surfaces are all inclined with the same angle that is preferably smaller than 45°, so that the clamp material takes up the major portion of the separating force, whereas only a smaller portion thereof has to be counteracted by the closing force actuators, so that the size thereof may be substantially reduced. In the most preferred embodiments said angle is between 6° and 12°, preferably 10°.

Preferred further embodiments of the tool assembly of the invention are specified in the respective dependent claims.

Another object of the invention is to provide an improved and very effective closing force application unit for a forming tool, presenting a solution to the problem of providing a closing force that securely and reliably counteracts the tool separating forces. In accordance with the invention this object is achieved by means of a closing force application unit consisting of at least one pair of tool clamps and at least two closing force actuators connected to each pair of clamps, said actuators applying a closing force to the tool during a forming process therein, through the clamps and through inclined contact surfaces on the clamps and on the tool.

Preferred embodiments of the closing force application unit of the invention are specified in the respective dependent claims.

Yet another object of the invention is to provide a method of closing upper and lower tool sections of a forming tool. In order to counteract the force generated by the forming pressure and to maintain the tool sections in firm contact with each other, a closing force is applied to the tool. According to the invention the closing force is basically applied in a direction parallel to the parting plane of the tool sections. The closing force is applied to the tool through inclined contact areas on upper and lower, outer surfaces of the tool sections on the one hand, and on inner facing surfaces of closing force application units on the other hand. This essentially reduces the closing force requirement, since the material of the force application units takes up part of the separating forces produced by the forming pressure.

In an embodiment of the method the closing force is controlled in dependence upon the actual generated tool separating force.

These and further objects of the invention are met by the invention as defined in the appended patent claims.

In summary, the present invention provides the following advantages over the state of the art:

The force required for counteracting the internal pressure from the forming operation within the tool, i.e. the force required for closing the tool during the forming cycle, is significantly reduced.

It provides a secure and precise locking or holding together of the tool sections even in applications with extreme internal pressures.

As a result of the reduced closing force requirement the size, complexity and cost of the closing force actuators can be greatly reduced.

It will be possible to eliminate any tendency of the tool clamps being widened by the tool separating forces.

The cycle times are substantially reduced as a result of the reduced closing force requirement and the concomitant reduced actuator size.

The tool will be easily accessible for positioning of blanks in the die and for removal of finished workpieces from the die, as well as for die changing and service work.

Other advantages offered by the present invention will be readily appreciated upon reading the below detailed description of embodiments of the invention.

BRIEF DESCRIPTION OF THE DRAWINGS

The invention, together with further objects and advantages thereof, may best be understood by making reference to the following description taken together with the accompanying drawings, in which:

FIG. 6 illustrates an upper half of a tool clamp according to the alternative embodiment of FIG. 5A, indicating different preferred areas of applying the closing force to the clamp;

FIG. 8 illustrates a modular arrangement of a hydroforming apparatus employing the principles of the present invention, in a partial plan view from above;

FIG. 9 is a side view of the modular arrangement according to FIG. 8, with the tool clamp actuators removed for reasons of clarity;

FIG. 10 illustrates, in cross section, a further alternative embodiment of a forming tool employing the principles of the present invention, intended for use in a flexforming process;

DETAILED DESCRIPTION

In the following description only elements necessary to explain the basic principles of the present invention will be described. Other elements that will typically be used in a practical implementation or that relate to the actual forming process, whether a hydroforming process or other process, such as pressure intensifiers, hydroforming dies and end feed cylinders, have been omitted or very schematically illustrated.

Figure 4:
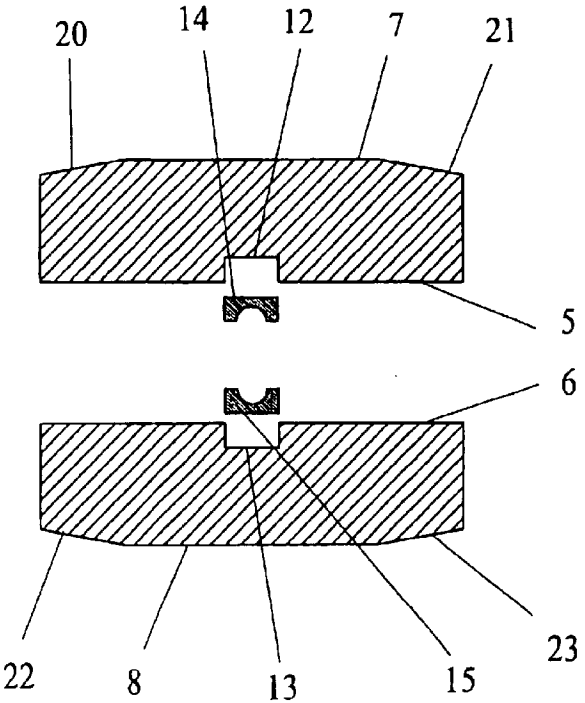
FIG. 4 is an enlarged cross section taken along line A—A in FIG. 1C, through an opened hydroforming tool of the embodiment illustrated in FIGS. 1A–C.
Figure 3:
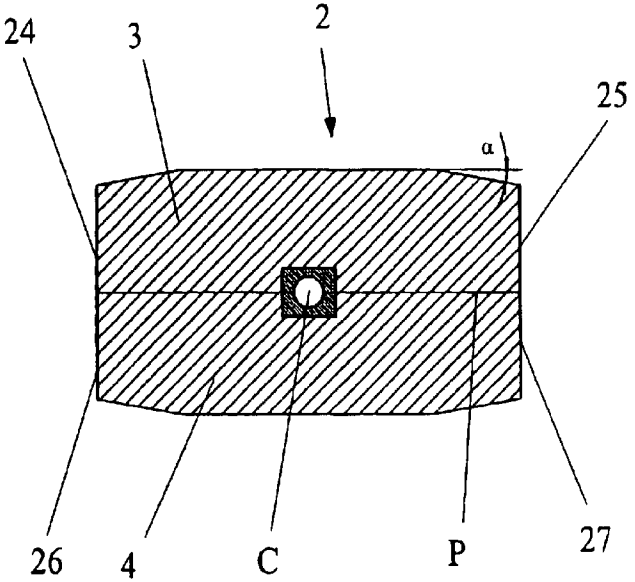
FIG. 3 is an enlarged cross-section, taken along line A—A in FIG. 1C, through a closed hydroforming tool of the embodiment illustrated in FIGS. 1A–C.

With specific reference to FIGS. 1A–C an exemplifying embodiment of the tool assembly 1 according to the invention will now be described in an application intended for a hydroforming apparatus. In this embodiment the hydroforming apparatus comprises a tool assembly 1 consisting of a forming tool 2 having a lower tool section 4 and an upper tool section 3. With reference to FIGS. 3 and 4, the tool sections 3, 4 have mating inner surfaces 6 and 5, respectively, forming a parting plane P of the tool assembly. At an outer surface 8 the lower tool section 4 is supported on a support surface 9 by a schematically illustrated base 10. The lower tool section 4 may be firmly attached to or movably supported (see further below) on the base 10. The base may be of any conventional type, such as a frame or a solid base. The upper tool section 3 is supported so as to be movable relative to the lower tool section 4. In the illustrated embodiment the upper tool section is movable in a generally vertical direction by means of lifting cylinders 11 (indicated in FIG. 1A) connected to an outer surface 7 thereof.

Figure 1A:
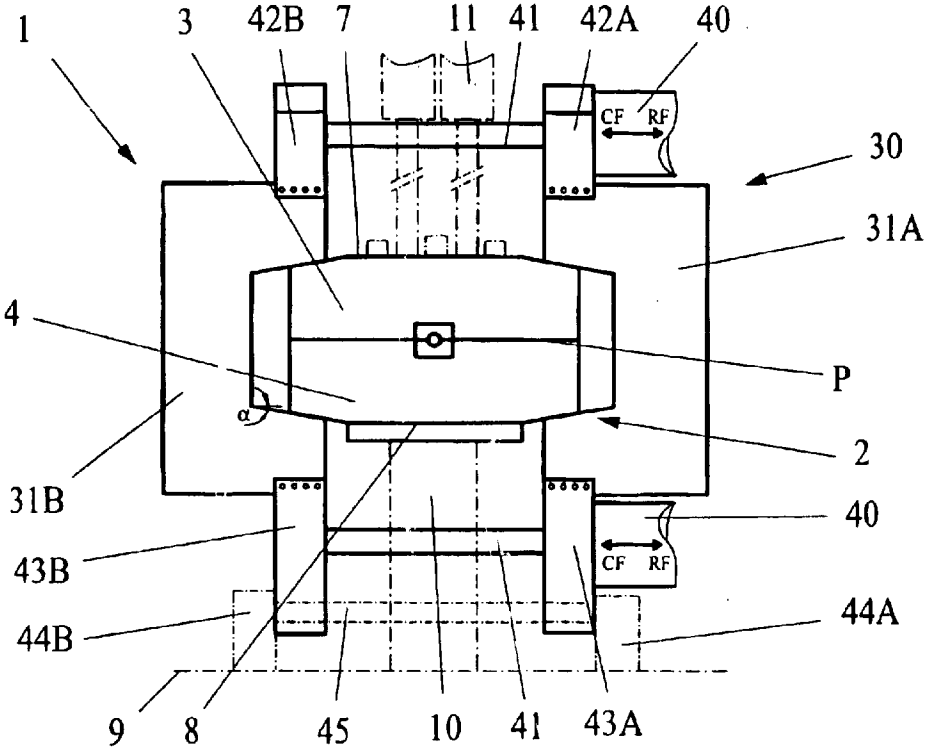
FIG. 1A is a partial side view schematically illustrating a first embodiment of the tool assembly of the invention applied to a hydroforming apparatus, with closing force actuators in an extended position, engaging the forming tool.
Figure 1B:
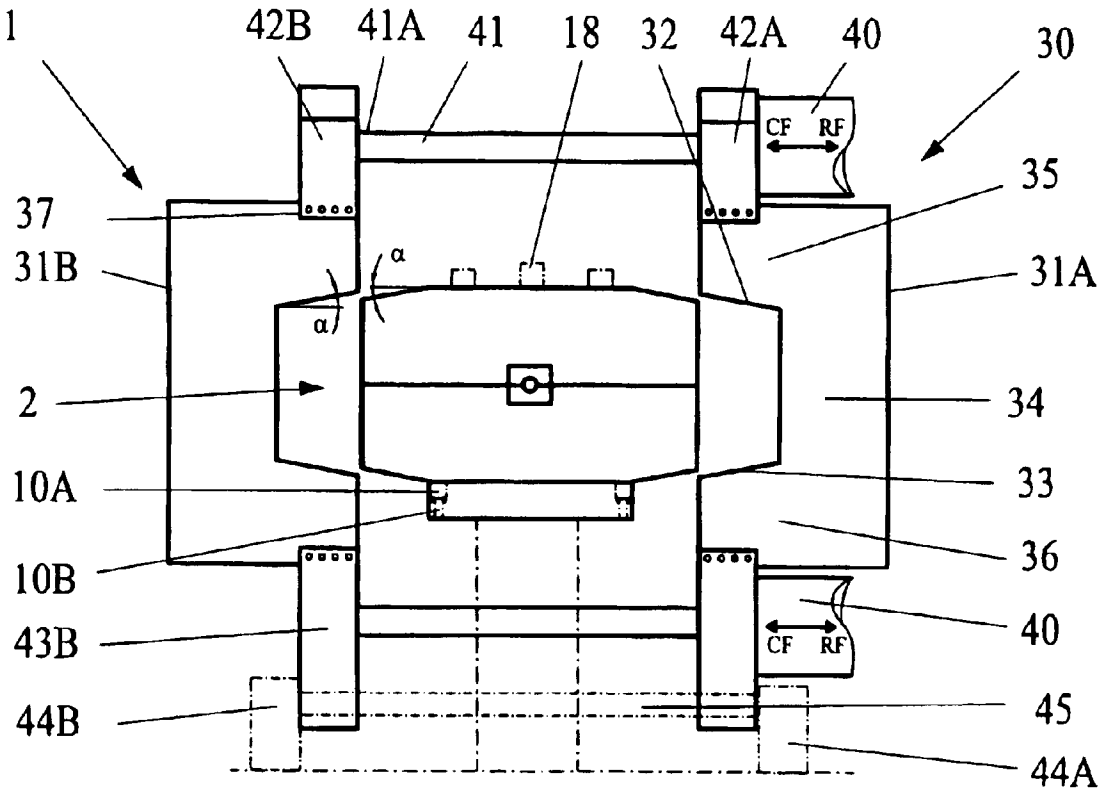
FIG. 1B is a partial side view of the first embodiment of the tool assembly, with the closing force actuators in a retracted position.
Figure 1C:
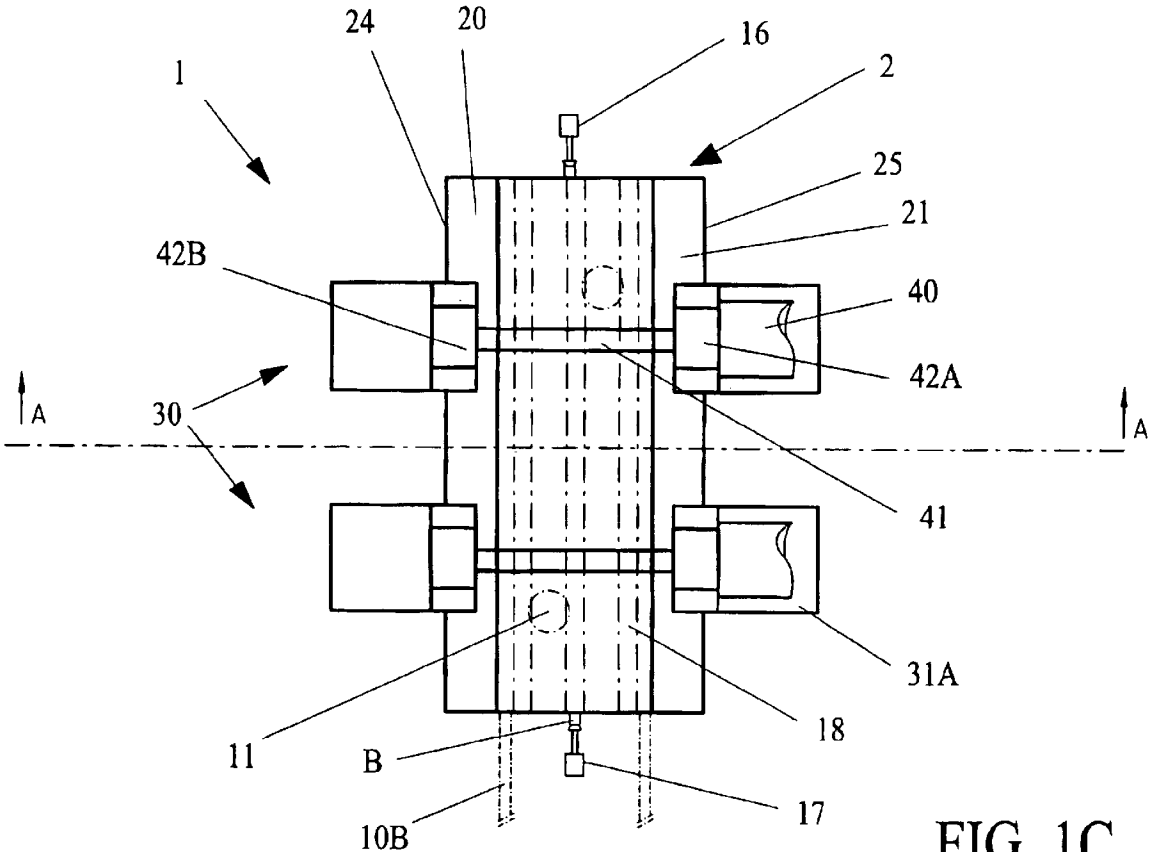
FIG. 1C is a partial plan view from above of the embodiment illustrated in FIGS. 1A and 1B.

FIGS. 1B and 1C indicate that in a modified variant the lower tool section 4 is movably supported on wheels 10*a* running on rails 10*b* attached to the base 10, so that it will be rolled out from underneath the upper tool section once the initial opening of the tool 2 has been performed. These functions may be performed using conventional supporting means and actuators, such as rails and hydraulic cylinders, since they will only have to carry the weight of the individual tool section. In the closed position, during the hydroforming process no additional forces are applied to such supporting means, since the later described tool clamps or closing force application clamps 31A, 31B and actuators 40 according to the invention take up all forces related to the hydroforming process. With this alternative configuration the loading and unloading of workpieces may be performed with full, unrestricted access to the lower tool section 4, and it is therefore well suited for a robot application.

Figure 7:
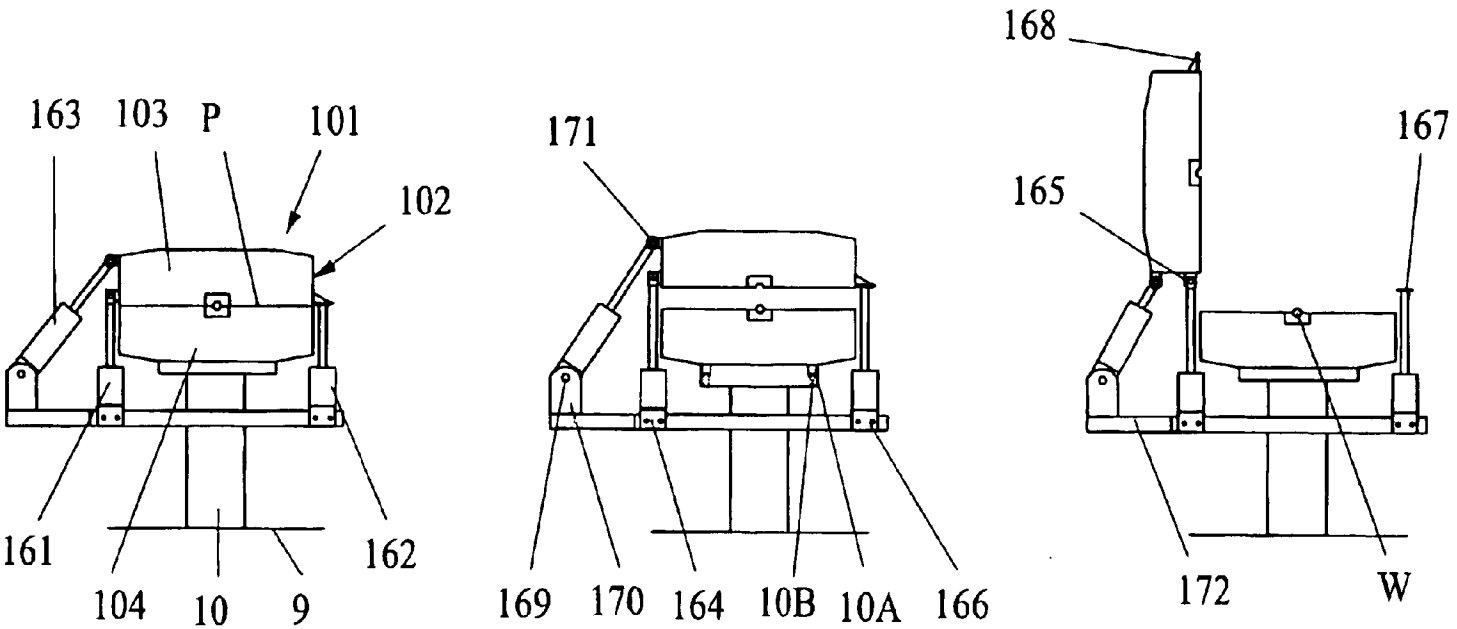
FIG. 7 illustrates an opening sequence for an embodiment of a hydroforming tool employing the principles of the present invention.

In an alternative that is not specifically illustrated, the upper tool section 3 will be supported in a frame and opening of the tool 2 is performed by lowering the lower tool section 4 slightly in a supporting carrier movable on the rails 10*a*. A further alternative embodiment of the movable support of the upper tool section 3 is illustrated in FIG. 7, and will be described further below.

In the illustrated embodiment the tool assembly 1 is designed for an internal hydroforming process, in which tubular workpieces are formed by means of pressurized fluid applied to an inner cavity of a blank B (see FIG. 1C). For this type of process the upper and lower tool sections 3, 4 are each provided with a recess 12 and 13 respectively, in their inner, mating surfaces 5, 6 (see FIGS. 3 and 4). The recesses 12, 13 are extended over the full length of the tool sections 3, 4 and receive upper and lower die sections 14 and 15 respectively. The die sections 14, 15 in themselves as well as their connection to the tool sections 3, 4 do not form any part of the present invention, and are therefore only illustrated very schematically and will not be described in any detail. It should be obvious that the invention may be used together with and modified for any applicable type of conventional die. In the conventional manner the die sections 14, 15 together form a die cavity C (see FIGS. 3 and 4) when the tool 2 is in its closed position. The die cavity C receives a blank B to be processed in the apparatus 1, and in the conventional manner the blank B extends out of the tool 2 with both of its ends (see FIG. 1C).

FIG. 1C also schematically illustrates the conventionally used end feed cylinders 16, 17 through which the pressurized fluid is introduced into the inner cavity of the blank B, and by means of which blank material is fed into the die cavity to compensate for the expansion of the blank B against the cavity walls. At the free end of their rod, the end feed cylinders 16, 17 carry a cone that is forcibly introduced into the inner cavity of the blank in order to expand the blank ends and to provide a seal against the introduced fluid, and in order to perform the above mentioned feeding of blank material, as is well known within this technique.

At their outer surfaces 7, 8 the tool sections 3, 4 are provided with inclined clamp contact surfaces or closing force application surfaces 20, 21, 22, 23, provided one along each of two opposite sides 24, 25, 26 and 27 respectively, of the tool sections 3, 4 (FIGS. 3 and 4). All of the closing force application surfaces 20, 21, 22, 23 are inclined so as to slope outwardly towards the associated side of the respective tool section, and they are all inclined with the same acute angle $\alpha$ relative to the inner surface of the associated tool section, and thereby to the parting plane P. The described closing force application surfaces 20, 21, 22, 23 may each extend along the entire, associated tool section sides 24, 25, 26 and 27 respectively, as is illustrated in FIG. 1C, but may likewise extend only along a portion or portions of said sides, corresponding to the extent of the associated, below described tool contact surfaces 32, 33 of a closing force application unit 30.

The tool 2 is manufactured from a material suitable for withstanding the below discussed forces applied thereto during the hydroforming process, preferably from steel or cast iron. Depending upon the chosen material for the tool 2 and/or upon the dimensions thereof, one or more reinforcements may be provided, as is exemplified in FIGS. 1A, 1B and 1C where three steel strengthening bars 18 are provided on the upper surface 7 of the upper tool section 3.

The illustrated tool 2 that is designed specifically for internal hydroforming is only used to exemplify the invention and the tool assembly 1 according to the invention may be employed in other applications for performing other forming processes operating with high internal pressures, such as injection molding, or for performing other hydroforming processes, such as flexforming. FIG. 10 illustrates a tool assembly designed for such an alternative hydroforming process, as will be described more closely below.

The tool assembly 1 further comprises closing force application units 30 comprising actuators 40 for applying the closing force to the tool 2 through tool clamps 31A, 31B. In the present embodiment said actuators are schematically illustrated as hydraulic cylinders being connected to the tool clamps. However, it should be emphasized that other conventional, linear actuators could be employed within the scope of the invention, especially in applications employing relatively low fluid pressures for the forming process.

The tool clamps 31A, 31B are generally C-shaped having two fixed jaws 35 and 36 extending outwardly from a solid base portion 34, as is illustrated in FIG. 1B and in greater detail in FIG. 6. The tool clamps 31A, 31B are positioned adjacent each of the two opposite sides 24, 25 (FIG. 1C) of the tool 2, with the open C-shape facing the tool 2. The jaws 35 and 36 are appropriately spaced apart to allow the closed tool 2 to be introduced between said jaws when the actuators 40 are activated. To allow the clamp jaws 35, 36 to grip a tool 2 properly from the outside, the inner, generally facing tool contact surfaces 32, 33 of the jaws 35 and 36 respectively, are inclined at an angle α relative to the working direction CF-RF of the actuator, i.e. the direction in which the actuator 40 applies the closing force CF to the tool 2 and the return force RF to retract the clamp 31A, 31B from the tool 2. This direction CF-RF in which the actuator 40 applies its force is substantially parallel to the parting plane P of the tool 2 and the angle of inclination α of the clamp surfaces 32, 33 is equal to that of the closing force application surfaces 20, 21, 22, 23 on the tool sections 3, 4. In the clamped condition, a considerable portion of the clamp jaws 35, 36 will grip the tool assembly from the outside and will counteract the separating forces generated by the fluid pressure and acting against the tool sections, as will be described.

Thanks to the cooperating wedge shaped surfaces 20–23 and 32, 33 on the tool sections 3, 4 and on the clamp jaws 35, 36, separation of the tool sections can be effectively counteracted by appropriate regulation of the closing force CF applied by the actuators 40, to secure that the applied closing force always exceeds the portion of the tool separating force that is not taken up by the clamp material. In other words, in the preferred embodiment of the invention the actuators are activated to apply the closing force CF to the tool during the entire forming process.

In the illustrated embodiment two pairs of tool clamps 31A, 31B are provided for each tool 2, each such pair comprising two opposed clamps 31A, 31B provided at the respective side 24, 26 and 25, 27 respectively of the tool 2. In the illustrated embodiment two actuators 40 operate each pair of tool clamps. The actuators 40 are connected to the clamps 31A, 31B, and in particular so as to apply the closing force in the area of the outer free ends of the jaws 35, 36. Specifically, in the illustrated embodiment the rod ends of the hydraulic cylinders 40 are attached to first clamp attachments 42A, 43A secured to the outwardly facing side of the respective clamp jaw 35, 36 of a first clamp 31A. The piston rods 41 of the actuators 40 span the tool 2 and their free outer ends 41A are in turn connected to second clamp attachments 42B, 43B secured to the outwardly facing side of the respective clamp jaw 35, 36 of a second, opposite clamp 31B. Therefore, it will now be obvious that retraction of the piston rods 41 will cause the opposing clamps 31A, 31B to move towards each other to thereby engage the tool 2 and apply the closing force. Likewise, extending the piston rods 41 will cause the clamps to move apart, disengaging the tool 2.

FIGS. 1A and 1B illustrate that the clamp attachments 42A–B and 43A–B are secured to the outer sides of the free ends of the clamp jaws 35 and 36 respectively. This configuration is favorable to eliminate outward flexing of the jaws caused by the internal pressure in the tool during a forming process, and is essential in applications with very high internal tool pressures, as will be described further in connection with FIG. 6.

FIG. 1A and 1B illustrate schematically that each pair of clamps 31A, 31B of the closing force application units 30 are individually movable, by being supported on one or several guide rods 45. The guide rods 45 extend through the lower part of the second clamp attachments 43A, 43B of each clamp pair, being slidably received therein by means of appropriate slide bearings (not illustrated). The ends of the slide rods 45 are secured in stands 44A, 44B fixed to the support surface 9.

In the illustrated embodiment each closing force application unit 30 comprises two pairs of mutually opposite clamps 31A, 31B with their respective actuators 40. Said pairs are positioned at a distance from each other along the tool 2. It should be emphasized that the number of clamp pairs for each closing force application unit 30 and/or the size of the actual clamps and actuators depends upon the actual application, such as the magnitude of the forming pressure, the size of the workpiece and of the tool 2. This will be evident when regarding the modular arrangement illustrated in FIGS. 8 and 9.

Figure 2:
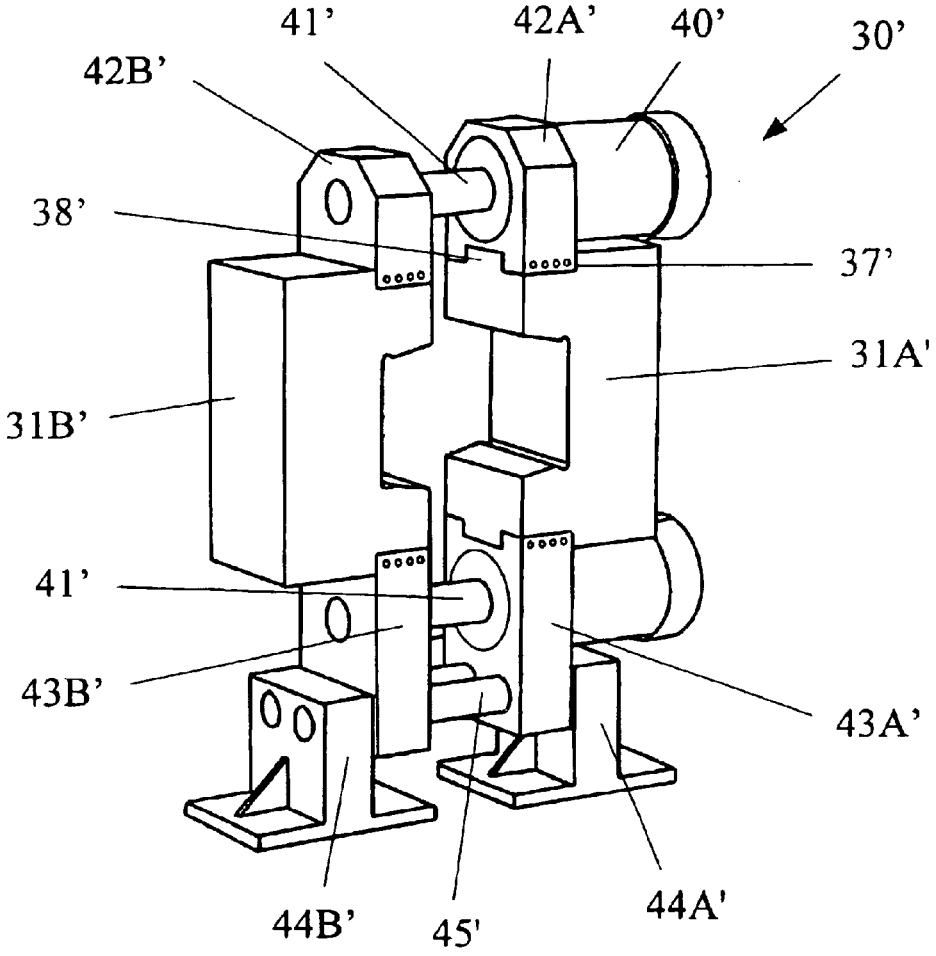
FIG. 2 is a perspective view of a practical configuration of a closing force application unit in accordance with the first embodiment of the invention illustrated in FIGS. 1A–C.

FIG. 2 illustrates an example of a practical configuration of a closing force application unit 30' of the embodiment illustrated in FIGS. 1A–C. In said drawing figure the corresponding parts have been given the same reference designations as in FIGS. 1A–C, but with the addition of a prim index.

Figure 5B:
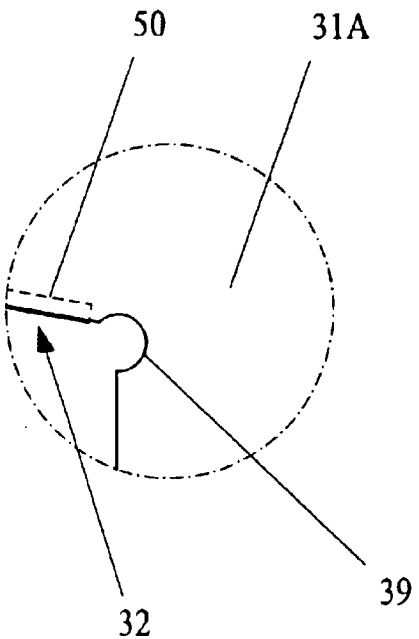
FIG. 5B illustrates a further enlarged detail of the tool clamp illustrated in FIG. 5A.
Figure 5A:
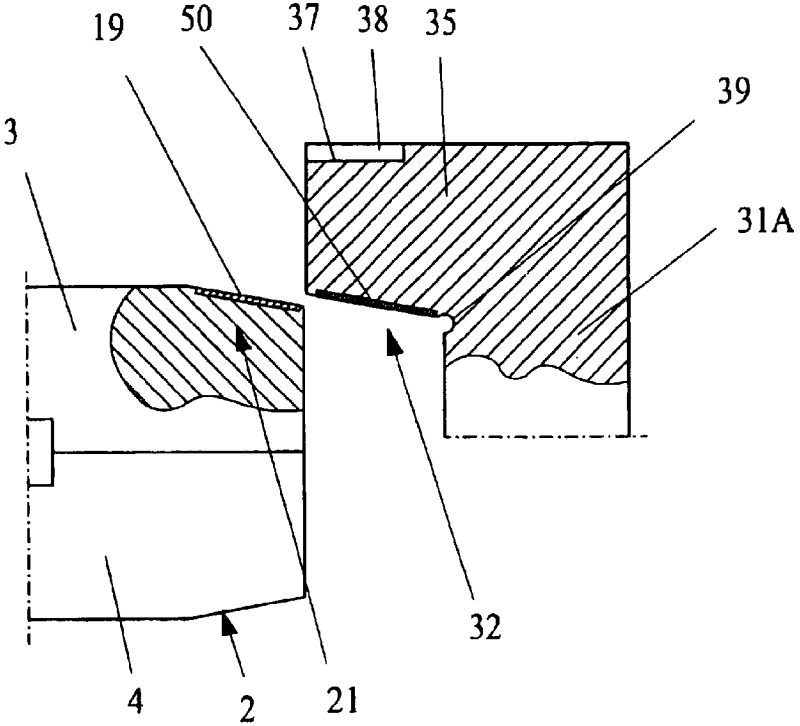
FIG. 5A illustrates an enlarged and partially sectioned detail of an alternative embodiment of a tool and an associated tool clamp of a closing force application unit.

FIG. 5A and 5B illustrate a further developed embodiment of the tool sections 3, 4 and a clamp 31A, where measures have been taken to reduce the friction between their inclined surfaces 20–23 and 32,33, and thus the wear of said surfaces. Specifically, a hardened steel plate 19 is illustrated, recessed in the upper tool section surface 21 so that its upper surface is at a level with the surface 21. Similar steel plates are recessed in all of the inclined surfaces of the tool sections, although not illustrated. Moreover, a similar plate 50 consisting of a synthetic composite material is recessed in each of the inner, generally facing tool contact surfaces 32, 33 of the clamp 31A, although only illustrated for the upper contact surface 32 in FIGS. 5A and 5B. In this case the surface of the composite plate 50 is slightly raised, in the order of a few millimeters, above the inner surface 32.

Finally, FIGS. 5A and 5B illustrate a recess 39 provided at the inner corner of the clamp 31A, where the jaw 35 meets the base portion 34. This is a preferred manner of providing an improved stress distribution in this critical area of the clamp material, with regard to the forces applied thereto during its clamping action.

The operation of the tool assembly 1 in a hydroforming operation will now be described. To begin the operation, the upper tool section 3 is lifted by means of the lifting cylinders 11. With the lower tool section exposed a blank B is positioned in the die cavity C of the lower die section 15, or alternatively, in the case that a new workpiece is to be formed, the upper and lower die sections 14, 15 are exchanged. When this work is completed the upper tool section 3 is lowered down onto the lower tool section 4 with the blank received in the cavity C. The closing force application units 30, that is their actuators 40, are then simultaneously activated to retract the rods 41 until the tool clamps 31A, 31B engage the inclined clamp contact surfaces 20–23 on the tool sections 3, 4 with their inclined tool contact surfaces 32, 33. The closing force CF applied by the actuators 40 is adjusted by regulating the hydraulic working fluid supplied thereto, said regulation being performed in any conventional manner.

The required closing force is determined primarily by the magnitude of the hydroforming fluid pressure applied inside the blank B, the size of the blank and of the tool 2 and by the value of the angle of inclination α of the surfaces 20–23 and 32, 33. The forming fluid pressure generates, through the blank B being pressed against the walls of the dies 14, 15, an outwardly directed normal force $F_{tool}$ in each of the inclined tool surfaces 20–23, counteracted by a force in the clamp surfaces 32, 33 generated by the force CF supplied by the actuators 40. Since the angle α is acute, i.e. less than 90°, the material of the clamp 31A, 31B, through the tool contact surfaces 32, 33, takes up a portion or component of this normal force and only a remaining portion or component thereof has to be counteracted by the closing force CF applied by means of the actuators 40. Thus, according to the invention, the size and complexity of the actuators 40 can be reduced. Any expansion, i.e. widening of the clamp jaws 35, 36 is automatically compensated for by a further retraction of the actuator rods 41, so that a firm contact is always maintained between the inclined surfaces 20–23 and 32, 33. This will secure that no separation of the tool sections 3, 4 will be possible.

As mentioned above the actual required closing force CF is partly determined by choosing the value of the angle α. In order to avoid any danger of locking the clamps 31A, 31B to the tool 2, like with a conventional tapered tool shank, the angle α should be chosen so as to be at least 3°, preferably at least 7°. On the other hand, to provide a significant reduction of the actuator size and complexity, the angle α should be chosen less than 45°, so that the major portion of the separating force will be taken up by the clamp material and only a smaller portion has to be counteracted by the closing force. At present it is believed that the best overall results will be obtained by choosing said angle a to be between 12° and 6°, preferably 10°. As an example, with the angle a being 10° the required closing force CF will be less than approximately 20% of the closing force required in a conventional vertically operating press.

With the tool 2 clamped in the described manner, the hydroforming pressurized fluid is introduced into the blank B in the conventional manner, through the end feed cylinders 17. The blank B is normally preformed at a relatively low pressure, before the full fluid pressure is applied to expand the blank B so that it receives the shape of the inner die walls. These steps are all conventional within the hydroforming technique, and will not be described in any detail. Once the forming operation is completed, the actuators 40 are activated in the opposite direction, to extend their rods 41 and remove the clamps 31A, 31B from the tool 2. The tool may now be opened for the unloading and loading work, preferably after the lower tool section 4 has been rolled to one side on the rails 10*b*. Finally the lower tool section 4 is rolled back in under the upper tool section 3, the tool 2 is closed and a new forming cycle can begin.

FIG. 6 illustrates an upper half of a clamp 31A with its base 34 and upper jaw 35. It will be seen therefrom that for the purposes of this description the base portion 34 of the clamp 31A only comprises the central portion between the jaws 35, 36. Thus, the jaws (only the upper one illustrated in FIG. 6) make out the complete outer part of the clamp, including all of the areas F1–F4 of FIG. 6.

In applications employing very high internal pressures in the tool 2 during forming operations it has been found to be essential to apply the closing force CF to the clamps 2 in the area of the jaws 35, 36. This is done to counteract the tendency of the jaws to deflect outwardly under the influence of the outwardly directed normal force $F_{tool}$ in each of the inclined tool surfaces 20–23, which might occur if the closing force CF was applied to the clamp 2 in the area of the basic portion 34. In other words, applying the closing force CF to the clamp in any of the areas F1–F4 of the jaw 35 will provide a counter-clockwise moment M—with regard to the illustration in FIG. 6—around the point PR. Such a moment M will effectively counteract any outward deflection of the jaw 35 caused by the force $F_{tool}$ from the tool 2. The desired size of this counteracting moment M can be chosen, depending upon the internal pressure of the tool and the dimensions as well as the material of the tool and of the clamp, by applying the closing force CF to different areas F1–F4 of the jaws. This is illustrated very schematically in FIG. 6 by means of the areas F1–F4, where the largest moment M is provided with the closing force applied approximately in the area F3. The produced moment then gradually decreases as the point of application is moved to the area F2, then to F4 and will be smallest in the area F1. Naturally the areas F1–F4 are only chosen in order to illustrate the general principle. In reality the applied moment varies gradually from point to point in the jaw 35.

FIG. 7 illustrates an alternative structure for providing the relative movement between the tool sections 103, 104 of a tool 102. Specifically FIG. 7 illustrates an opening sequence for the tool, after a performed workpiece W forming process. Like in the first embodiment, the lower tool section 104 is supported on a support surface 9 by a supporting base 10. To the supporting base 10 is also attached a frame 172 carrying three hydraulic cylinders 161, 162, 163 employed to open and close the tool 102. A first lifting cylinder 161 is firmly connected to the frame 172 at its rear end, as is indicated at 164. The rod end of the first cylinder 161 is pivotally connected to a first side of the upper tool section 103 through a conventional joint, as indicated at 165. A second lifting cylinder 162 is likewise firmly connected to the frame 172 at its rear end, as is indicated at 166. The rod end of the second lifting cylinder 162 carries a lifting plate 167 at its rod end. This lifting plate 167 contacts a lifting support 168 on the opposite, second side of the upper tool section 103 during the initial phase of the lifting movement but is not connected thereto. Finally, with its rear end a third cylinder 163 is pivotally supported in a cylinder mount 170 on the frame 172, as is indicated at 169. At its rod end the third cylinder 163 is pivotally connected to the upper tool section 103, likewise through a conventional joint 171, and at a position spaced apart upwardly from the pivotal joint 165 of the first cylinder 161.

To the left in FIG. 7 the tool is illustrated in a position with the upper tool section 103 resting on the lower tool section 104 in the parting plane P, such as after a forming cycle. In this position, the first and second lifting cylinders 161, 162 are activated to raise the upper tool section 103 straight upwardly from the lower tool section 104, as is indicated in the middle drawing of FIG. 7.

Figure 12:
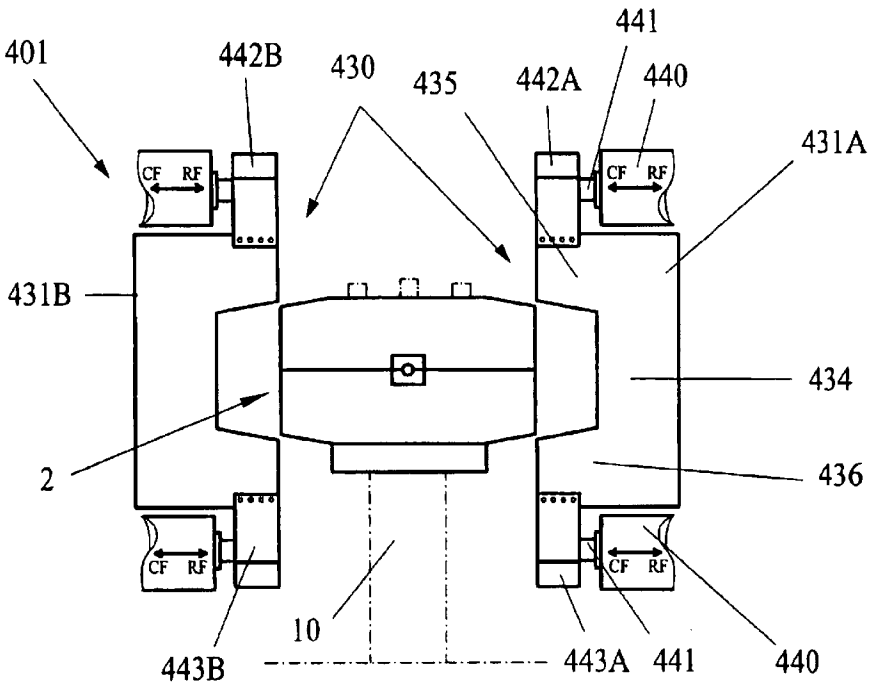
FIG. 12 is a partial side view corresponding to FIG. 1B, of a modified closing force application unit according to the invention.

During this sequence the third cylinder 163 is totally relieved so that its rod will be extended due to the raising of the upper tool section 103. Next, the rod of the third cylinder 163 is retracted. This will swing the upper tool section 103 in a counter clockwise direction around a pivot formed by the pivotal joint 165, to the fully open position illustrated to the right in FIG. 7. Maneuvering the cylinders in the reverse sequence carries out the lowering of the upper tool section 103 down onto the lower tool section 104. The lifting arrangement illustrated in FIG. 7 provides excellent access to the tool 102, since it leaves the space above the tool totally free for loading, unloading and service work in the open tool condition, even more so if it is combined with the wheels 10*a* and rails 10*b* (illustrated in the middle of FIG. 7) according to the modified alternative of the first embodiment, so that the lower tool section 104 may be rolled out from the closing position for the loading and unloading. The closing force application unit has been excluded in the illustration of FIG. 7. However, this embodiment of the tool 102 requires a modified variant of said closing force application unit, since the swinging movement of the upper tool section 103 would interfere with the actuator rods in the first embodiment of the closing force application unit 30 illustrated in FIGS. 1A–C and 2. However, FIG. 12 illustrates such a modified closing force application unit, as will be described further below.

FIG. 8 and 9 illustrate a further application of the principles of the invention to a hydroforming apparatus in a specific modular arrangement suitable for forming long workpieces W that have a shape with several, relatively large bends in two planes. This embodiment illustrates the versatility that may be accomplished for a hydroforming apparatus employing tool assemblies 201 according the invention. Tools 202A–C of different length provided in an end-to-end relationship. The individual tools 202A–C are identical to the one illustrated in FIGS. 1A, 1B and 1C, only shorter, tools 202B–C, and/or provided with end faces inclined to accommodate said bends of the workpiece W, in one or both of the two planes. As indicated in FIG. 8, closing force application units 230A, 230B having at least one pair of clamps 231A, 231B and at least two actuators 240A, 240B are provided for each tool assembly 202A–C of the line. Said closing force application units, clamps and actuators are only schematically illustrated, but in this case each clamp is carried by only one actuator connected to the base portion of the clamp. Such a configuration is only appropriate for applications with moderate internal tool pressures, as described above. In other applications the closing force application units and actuators may preferably correspond to those of the first embodiment, with the exception that smaller sized closing force application units 230B and actuators 240B are provided for the shorter tool assemblies 202B–C. FIG. 8 is a schematical top plan view of the hydroforming apparatus, whereas FIG. 9 is a corresponding side view, but with the actuators removed, to illustrate the bends in the second plane.

FIG. 10 illustrates a further embodiment of a tool 302 for use with the invention, designed as a flexforming tool. In a flexforming tool 302 the lower tool section 304 receives a die 315 having its inner wall matching the shape of the finished workpiece and forming the die cavity C. The upper tool section 303 has a pressure fluid cavity 314 closed downwardly by a rubber membrane 300 lying substantially in the parting plane P of the closed tool 302. A blank B in the form of a metal plate is placed on the lower tool section 304, the upper tool section 303 with the membrane 300 is lowered down onto the lower tool section 304, and actuators (not shown) are activated to move their associated closing clamps 31A to the closing position. Like in the previous embodiment the tool clamp surfaces 32 and 33 are brought into engagement with the corresponding surfaces 321 and 323 on the upper and lower tool sections 303, 304. Then pressurized fluid is introduced into the pressure fluid cavity 314 in a manner that is not specifically illustrated, but that is well known in the art. The pressurized fluid, through the rubber membrane 300, forces the blank B into the die 315 to receive its final shape, as is conventional.

Figure 11:
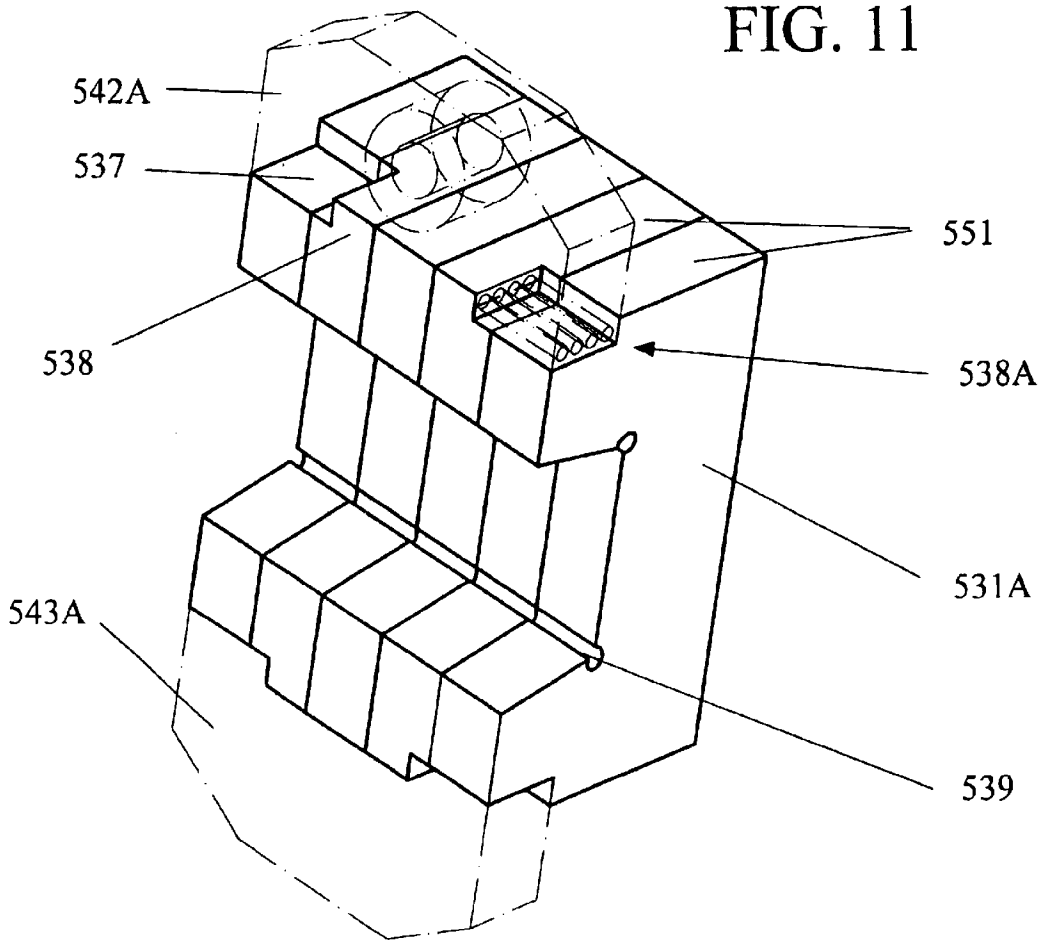
FIG. 11 is a perspective view of an alternative embodiment of the tool clamp.

FIG. 11 illustrates a further developed embodiment of an actuator tool clamp 531A. In this embodiment the tool clamp is made up of a number of, in the illustrated embodiment five, parallel plates 551 attached to each other in an arrangement side-by-side. This results in a very strong and wear resistant clamp 531A, specifically so in combination with the inserts illustrated in FIGS. 5 and 6. In the drawing figure is also schematically illustrated how the clamp attachments 542A, 543A are secured to the actual clamp 531A. Two recesses 537 are formed in each of the upper and lower, outer surfaces of the clamp, and are spaced apart so as to leave a raised portion 538 therebetween. The attachments 542A, 542B are provided with a complementary shape, and are fastened to the clamp by means of bolts (not illustrated) introduced into schematically illustrated bores 538A in the attachments and in the clamp.

Finally, FIG. 12 illustrates a further embodiment of a tool assembly 401 of the invention, specifically suited for applications where a free space must be provided above and below the tool 2, such as with the tool lifting equipment illustrated in FIG. 7. In this case the closing force application unit 430 comprises four actuators 440 for the pair of clamps 431A, 431B. In other words, the closing force CF is applied separately to each clamp 431A or 431B of a pair by means of two actuators 440. In this embodiment the actuators 440 are supported separate from the clamps and carry the clamps at the free ends of their piston rods 441 through the clamp attachments 442A–B, 443A–B.

Although the invention has been described herein with specific reference to hydroforming applications, it shall be emphasized that the invention in its basic scope covers any application where a high internal pressure is employed between forming tool halves, such as in injection molding where die sections are provided in at least one tool section for receiving pressurized material intended for forming an article.

It will be understood by those skilled in the art that various other modifications and changes may be made to the present invention without departure from the scope thereof, which is defined by the appended claims.

What is claimed is:

1. Tool assembly (1; 101; 201; 401) comprising:

a forming tool (2; 102; 202A–C; 302) having at least one pair of upper and lower tool sections (3,4; 103,104; 303, 304) being relatively moveable between an open loading and unloading position and a closed forming position in which the tool sections (3,4; 103,104; 303,304) form a die cavity (C):

at least one pair of generally C-shaped tool clamps (31A, 31B; 31A', 31B'; 231A, 231B; 431A, 431B; 531A), said clamps engaging the tool from opposite sides (24,26; 25; 27) thereof and having inner, inclined tool contact surfaces (32,33) for engaging outer, inclined clamp contact surfaces (20,21,22,23; 321,323) on the tool sections (3, 4; 303, 304); and at least two closing force actuators (40; 40'; 240A, 240B, 440) provided for each pair of tool clamps (31A, 31B; 31A', 31B'; 431A, 431B; 531A), said actuators connected to the tool clamps for applying a closing force (CF) to the tool (2; 102; 202A–C; 302) during a forming process, whereby said closing force is applied to the tool through said tool contact surfaces and clamp contact surfaces.

2. Tool assembly (1; 101; 201; 401) according to claim 1, characterized in that the closing force actuators (40; 40'; 240A, 240B; 440) are linearly working actuators arranged to apply the closing force (CF) in a direction (CF-RF) being substantially parallel to a parting plane (P) of the tool (2; 102; 202A–C; 302), the parting plane defined as mating inner surfaces of the upper and lower tool sections.

3. Tool assembly (1; 101; 201; 401) according to claim 1, characterized in that the closing force actuators (40; 40'; 240A, 240B; 440) are hydraulic cylinders with piston rods, a free end of the piston rods being connected to the corresponding tool clamp (31A; 31B; 31A', 31B'; 231A, 231B; 431A, 431B; 531A).

4. Tool assembly (1; 101; 201; 401) according to claim 3, characterized in that the hydraulic cylinders (40; 40'; 240A, 240B; 440) are connected to a hydraulic fluid source of variable pressure, so that the applied closing force (CF) is controllable by varying a working fluid pressure of the cylinders.

5. Tool assembly (1; 101; 201; 401) according to claim 1, characterized in that each tool clamp (31A, 31B; 31A'; 31B'; 431A, 431B; 531A) comprises a base portion (34; 434) and fixed jaws (35,35; 435,436) extending outwardly from the base portion (34; 434).

6. Tool assembly (1; 101; 401) according to claim 5, characterized in that the closing force actuators (40; 40'; 440) are connected to the jaws (35, 36; 435, 436) of the tool clamps (31A, 31B; 31A', 31B'; 431A, 431B; 531A).

7. Tool assembly (1; 101; 401) according to claim 6, wherein the jaws have outer areas and characterized in that the closing force actuators (40; 40'; 440) are connected to the outer areas (F3, F2) of the jaws (35, 35; 435, 436) of the tool clamps (31A, 31B; 31A', 31B'; 431A, 431B; 531A).

8. Tool assembly (1; 101; 201; 401) according to claim 1, characterized by a plate (50) of synthetic material at least substantially recessed in each of the inner, inclined tool contact surfaces (32, 33) of the clamps (31A, 31B) and by a hardened steel plate (19) being recessed in each of the outer, inclined clamp contact surfaces (20,21,22,23) of the tool sections (3, 4), with an outer surface of the hardened steel plate being substantially level with said inclined clamp contact surface.

9. Tool assembly (101) according to claim 1, characterized in that the upper tool section (103) is supported by i) a first hydraulic lifting cylinder (161) being pivotally attached, at a point of attachment, to a first side of the upper tool section, ii) a second lifting cylinder (162) separate from, but engaging a second, opposite side of the upper tool section and iii) a third opening cylinder (163) being pivotally attached to said first side of the upper tool section at a distance from the point of attachment of the first cylinder.

10. Tool assembly (1) according to claim 2, characterized in that two hydraulic cylinders (40; 40') are connected to each pair of tool clamps (31A, 31B; 31A', 31B'; 531A) through clamp attachments 42A, 42B, 43A, 43B; 42A', 42B', 43A', 43B'; 542A, 543A), free ends (41A) of piston rods (41; 41') from the two hydraulic cylinders being connected to one clamp (31B; 31B') of the pair of clamps, and rod ends of the hydraulic cylinders (40; 40') being connected to the other clamp (31A; 31A'; 531A) of the pair of clamps.

11. Tool assembly (401) according to claim 10, characterized in that two hydraulic cylinders (440) are connected to each tool clamp (431 A, 431B) of the pair of clamps at the free ends (441) of the piston rods (441), said free ends facing the tool (2).

12. The tool assembly (1; 101) according to claim 1 in combinations with rails provided below the lower tool section, characterized in that the lower tool section (4; 104) is moveably supported on wheels (10A) running on the rails (10B) provided below said lower tool section.

13. Tool assembly (1; 101; 201; 401) according to claim 1, characterized in that the tool contact surfaces (32, 33) and the clamp contact surfaces (20,21,22,23) are all inclined with the same acute angle ($\alpha$) of inclination but in opposite directions relative to a parting plant (P) of the tool (2; 102; 202A–C; 302) the angle of inclination being $90° \geqq \alpha \geqq 3°$.

14. Tool assembly (1; 101; 201; 401) according to claim 13, characterized in that the angle of inclination of the tool contact surfaces (32,33) and of the clamp contact surfaces (20, 21, 22 23) is $12° \geqq \alpha \geqq 6°$.

15. Tool assembly (1; 101; 201; 401) according to claim 1, characterized in that the tool (2; 102; 202A–C; 302) is a hydroforming tool having die sections (14, 15; 315) provided in at least one of the tool sections (3, 4; 303, 304) for receiving a workpiece blank (B) to be formed, said blank being formed against the wall of the at least one die section by pressurized fluid supplied to a surface of the blank.

16. Tool assembly (1; 101; 201; 401) according to claim 15, characterized in that the tool (2; 102; 202A–C) is a tool for internal hydroforming, having an upper die section (14) received in a recess (12) in a lower surface (5) of the upper tool section (3) and a lower die section (15) received in a recess (13) in a upper surface (6) of the lower tool section (4), said upper and lower die sections forming a die cavity (C).

17. Tool assembly according to claim 15, characterized in that the tool (302) is a flexforming tool with an upper tool section (303) having an inner forming fluid cavity (314), a lower tool section (304) having an inner die (315) forming a die cavity (C) and a membrane (300) of a material provided approximately in a parting plane (P) of the tool.

18. Tool assembly (1; 101; 201; 401) according to claim 1, characterized in that the tool (2; 102; 202A–C; 302) is an injection molding tool having die sections (14,15: 315) provided in at least one of the tool sections (3, 4; 303, 304) for receiving pressurized material for forming an article.

19. Tool assembly (201) according to claim 1, characterized in that several tools (202A–C) are provided in a modular arrangement in an end-to-end relationship for receiving long workpieces (W), each tool (202A–C) being provided with at least one pair of clamps (231 A, 231 B) and two actuators (240A, 240B).

20. Tool assembly (201) according to claim 19, characterized in that at least some of the tools (202A–C) are inclined and in that ends of the inclined tools (202A–C) are likewise inclined to permit the end-to-end relationship, thereby accommodating workpieces (W) having larger bends in at least one plane.

21. A closing force application unit (30; 30'; 230A, 230B; 430) for a forming tool (2; 102; 202A–C; 302) comprising at least one pair of upper and lower tool sections (3, 4; 303, 304) being relatively moveable between an open loading and unloading position and a closed forming position in which the tool sections (3, 4; 103, 104; 303, 304) form a die cavity (C), characterized by at least one pair of generally C-shaped tool clamps (31A, 31B; 31A, 31B'; 231A, 231B; 431A, 431B; 531A) each having two inner, inclined tool contact surfaces (32, 33) for engaging outer, inclined clamp contact surfaces (20, 21, 22, 23; 321, 323) on opposite sides (24,26; 25; 27) of the tool sections (3,4; 303, 304) and by at least two closing force actuators (40; 40'; 240A, 240B; 440) connected to each pair of tool clamps (31A, 31B; 31A', 31B'; 231A, 231B; 431A, 431B; 531A) for applying a closing force (CF) thereto, whereby said closing force is applied to the tool (2; 102; 202A–C; 302), during a forming process therein, through said tool contact surfaces and clamp contact surfaces.

22. A closing force application unit (30; 30'; 230A, 230B; 430) according to claim 21, characterized in that the closing force actuators (40; 40', 240A, 240B; 440) are linearly working actuators arranged to apply the closing force (CF) in a direction (CF-RF) being substantially parallel to a parting plane (P) of the forming tool (2; 102; 202A–C; 302), the parting plane defined as mating inner surfaces of the upper and lower tool sections.

23. A closing force application unit (30; 30'; 230A, 230B; 430) according to claim 21, characterized in that the closing force actuators (40; 40', 240A, 240B: 440) are hydraulic cylinders with piston rods, a free end of the piston rods being connected to the corresponding tool clamp (31A, 31B; 31A', 31B'; 231A, 231B; 431A, 431B; 531A).

24. A closing force application unit (30; 30'; 230A, 230B; 430) according to claim 23, characterized in that the hydraulic cylinders (40, 40'; 240A, 240B: 440) are connected to a hydraulic fluid source of variable pressure, so that the applied closing force (CF) is controllable by varying a working fluid pressure of the cylinders.

25. A closing force application unit (30; 30'; 230A, 230B; 430) according to claim 21, characterized in that each tool clamp (31A, 31B; 31A', 31B'; 431A, 431B; 531A) comprises a base portion (34; 434) and fixed jaws (35, 35; 435, 436) extending outwardly from the base portion (34; 434).

26. A closing force application unit (30; 30'; 430) according to claim 25, characterized in that the closing force actuators (40; 40'; 440) are connected to the jaws (35; 36; 435, 436) of the tool clamps (31A, 31B; 31A', 31B'; 431A, 431B, 531A).

27. A closing force application unit (30; 30'; 430) according to claim 26, wherein the jaws have outer areas and characterized in that the closing force actuators (40; 40'; 440) are connected to the outer areas (F3, F2) of the jaws (35, 35; 435, 436) of the tool clamps (31A, 31B; 31A', 31B'; 431A, 431B; 531A).

28. A closing force application unit (30; 30'; 230A; 230B; 430) according to claim 21, characterized by a plate (50) of synthetic material at least substantially recessed in each of the inclined tool contact surfaces (32, 33) of the clamps (31A, 31B), the outer surface thereof being positioned approximately level with the tool contact surface of the clamp.

29. A closing force application unit (30; 30') according to claim 23, characterized in that two hydraulic cylinders (40; 40') are connected to each pair of tool clamps (31A, 31B; 31A', 31B'; 531A) through clamp attachments (42A, 42B, 43A, 43B; 42A', 42B', 43A', 43B'; 542A, 543A), free ends (41 A) of piston rods (41; 41') from the two hydraulic cylinders being connected to one clamp (31 B; 31B') of the pair of clamps, and rod ends of the hydraulic cylinders (40; 40') being connected to the other clamp (31A; 31A'; 531 A) of the pair of clamps.

30. A closing force application unit (430) according to claim 29, characterized in that two hydraulic cylinders (440) are connected to each tool clamp (431 A, 431B) at the free ends (441) of the piston rods (441), said free ends facing the tool (2).

31. A closing force application unit (30; 30'; 230A, 230B; 430) according to claim 21, characterized in that the tool contact surfaces (32,33) are all inclined with the same acute angle ($\alpha$) of inclination but in opposite directions relative to a parting plane (P) of the tool (2; 102; 202A–C; 302), the angle of inclination being $90° \geqq \alpha \geqq 3°$.

32. A closing force application unit (30; 30'; 230A, 230B; 430) according to claim 31, characterized in that the angle of inclination of the tool contact surfaces (32,33) and of the clamp contact surfaces (20,21,22,23) is $12° \geqq \alpha \geqq 6°$.

33. A method of closing mating upper and lower tool sections (3,4; 103,104; 303,304) of a forming tool (2; 102; 202A–C; 302):

creating a separating force (Ftool) by applying to the tool sections a pressurized fluid supplied to an inner die cavity (C) of the tool;

applying to the tool sections a closing force (CF), counteracting the separating force (Ftool) in order to maintain the tool sections in mating contact through facing inner surfaces (5,6) of the tool sections forming a parting plane (P) of the tool, wherein, the closing force (CF) is applied in a direction substantially parallel to the parting plane (P) and is introduced into the tool (2; 102; 202A–C; 302) through contact areas (20, 21, 22, 23; 321, 323; 32, 33) that are inclined at equal acute angles relative to the parting plane (P) and positioned on upper and lower, outer surfaces (7,8) of the tool sections, and also positioned on inner generally facing surfaces of closing force application units (30; 30'; 230A, 230B; 430).

34. A method according to claim 33, comprising the further step of regulating the closing force (CF) in dependence upon the separating force (Ftool) generated in the tool (2; 102; 202A–C; 302).

35. A method according to claim 33, wherein the step of applying the closing force (CF) to the tool sections (3,4; 103,104; 303,304) is accomplished by closing force actuators (40; 40'; 240A, 240B; 440) and through outwardly extending jaws (35, 35; 435, 436) of generally C-shaped tool clamps (31A, 31B; 31A', 31B'; 431A, 431B; 531A), and comprising the further step of closing of the tool sections by bringing the tool clamps to a position engaging at least a portion of one side of the upper and lower tool sections from the outside, whereby a part of the tool section separating force is counteracted by the closing force actuators and by material of the tool clamps, through said inclined contact areas (20, 21, 22, 23; 321, 323; 32, 33).

* * * * *